US011333362B2

(12) United States Patent
Alberti

(10) Patent No.: US 11,333,362 B2
(45) Date of Patent: May 17, 2022

(54) APPLIANCE IGNITOR ASSEMBLY

(71) Applicant: WHIRLPOOL CORPORATION, Benton Harbor, MI (US)

(72) Inventor: Carlo Alberti, Fabriano (IT)

(73) Assignee: Whirlpool Corporation, Benton Harbor, MI (US)

( * ) Notice: Subject to any disclaimer, the term of this patent is extended or adjusted under 35 U.S.C. 154(b) by 34 days.

(21) Appl. No.: 17/030,341

(22) Filed: Sep. 23, 2020

(65) Prior Publication Data

US 2022/0090792 A1 Mar. 24, 2022

(51) Int. Cl.
*F24C 3/10* (2006.01)
*F24C 3/12* (2006.01)

(52) U.S. Cl.
CPC ..... *F24C 3/10* (2013.01); *F24C 3/128* (2013.01)

(58) Field of Classification Search
CPC .. F24C 3/025; F24C 3/082; F24C 3/10; F24C 3/103; F24C 3/112; F24C 3/122; F24C 3/128
USPC ..... 126/25 B, 39 BA, 39 E, 39 N, 52; 431/256–257, 277
See application file for complete search history.

(56) References Cited

U.S. PATENT DOCUMENTS

| | | | | |
|---|---|---|---|---|
| 3,646,927 | A | 3/1972 | Perl | |
| 4,005,697 | A | 2/1977 | Perl | |
| 2019/0137100 | A1 * | 5/2019 | Chirumbolo | F23Q 3/006 |

FOREIGN PATENT DOCUMENTS

| | | | | |
|---|---|---|---|---|
| DE | 1809936 | A1 | 6/1970 | |
| EP | 0455896 | A2 * | 11/1991 | F24C 3/103 |
| EP | 1167883 | A2 | 1/2002 | |
| EP | 3839351 | A1 | 6/2021 | |
| FR | 1382571 | A | 12/1964 | |
| GB | 1277878 | | 6/1972 | |
| GB | 1538928 | A | 1/1979 | |

* cited by examiner

*Primary Examiner* — Vivek K Shirsat
(74) *Attorney, Agent, or Firm* — Price Heneveld LLP

(57) ABSTRACT

An ignitor assembly for an appliance includes first and second taps coupled with a conduit. Each tap has a shaft extending upward from a body. A first support is coupled with the first tap, and a second support is coupled with the second tap. Each of the first and second supports includes a body portion positioned about the shaft of the respective tap and a protrusion extending from the body portion and defining a channel. The second support further includes a switch portion. A cross-member is rotatably coupled with each of the first and second supports and includes a switch lever positioned proximate the second support. Actuation of either of the first and second taps rotates the cross-member. A switch is coupled with the switch portion of the second support and configured to be actuated by the switch lever of the cross-member during rotation of the cross-member.

20 Claims, 8 Drawing Sheets

APPLIANCE IGNITOR ASSEMBLY

BACKGROUND OF THE DISCLOSURE

The present disclosure generally relates to an ignitor assembly for an appliance, and more specifically, to an ignitor assembly for an appliance and having a single switch.

SUMMARY OF THE DISCLOSURE

According to one aspect of the present disclosure, an ignitor assembly for an appliance includes first and second taps coupled with a conduit. Each tap may have a shaft extending upward from a body. A first support may be coupled with the first tap and may include a body portion positioned about the shaft of the first tap and a protrusion extending from the body portion and defining a channel. A second support may be coupled with the second tap. The second support may include a body portion positioned about the shaft of the second tap, a protrusion extending from the body portion and defining a channel, and a switch portion. A cross-member may be rotatably coupled with each of the first and second supports and may include a switch lever positioned proximate the second support. Actuation of either of the first and second taps may rotate the cross-member. A switch may be coupled with the switch portion of the second support and may be configured to be actuated by the switch lever of the cross-member during rotation of the cross-member.

According to another aspect of the present disclosure, an ignitor assembly for a cooking appliance includes a first tap coupled with a conduit and having a shaft extending upward from a body and a second tap coupled with the conduit and having a shaft extending upward from a body. A first support may be coupled with the first tap and may include a body portion positioned about the shaft. A second support may be coupled with the second tap and may include a body portion positioned about the shaft and a switch portion extending from the body portion. A cross-member may be rotatably coupled with the first and second supports. The cross-member may include a first tap lever positioned proximate the shaft of the first tap, a second tap lever positioned proximate the shaft of the second tap, and a switch lever positioned proximate the switch portion. The cross-member may be rotatable between a disengaged position and an engaged position. A switch may be coupled with the switch portion and may be configured to be actuated by the switch lever when the cross-member is in the engaged position.

According to yet another aspect of the present disclosure, an ignitor assembly for a cooking appliance includes first and second taps coupled with a conduit extending along a portion of a cooktop. The cooktop may include first and second burners. The first burner may be selectively actuated by the first tap, and the second burner may be selectively actuated by the second tap. A first support may be coupled with the first tap, and a second support may be coupled with the second tap and may include a switch portion. A cross-member may be rotatably coupled with the first and second supports. The cross-member may include a first tap lever positioned proximate the first tap, a second tap lever positioned proximate the second tap, and a switch lever positioned proximate the switch portion. Opening of the first tap may rotate the cross-member from a disengaged position to an engaged position, and opening of the second tap may rotate the cross-member from the disengaged position to the engaged position. A switch may be coupled with the switch portion and may be configured to be actuated by the switch lever when the cross-member is in the engaged position.

These and other features, advantages, and objects of the present disclosure will be further understood and appreciated by those skilled in the art by reference to the following specification, claims, and appended drawings.

Figure 1:
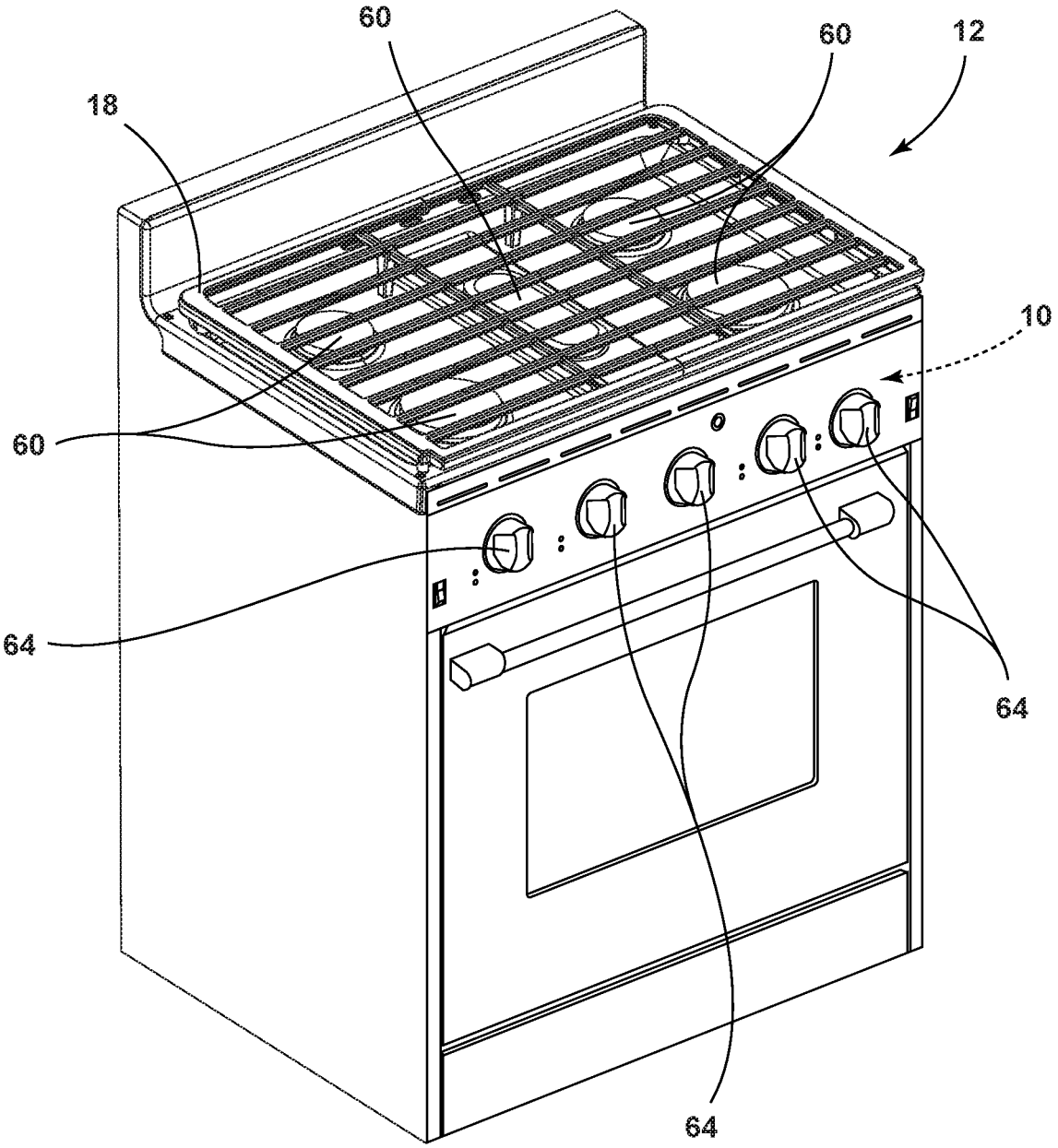
FIG. 1 is a front perspective view of an appliance, according to various examples.

The components in the figures are not necessarily to scale, emphasis instead being placed upon illustrating the principles described herein.

DETAILED DESCRIPTION

The present illustrated embodiments reside primarily in combinations of method steps and apparatus components related to an ignitor assembly for an appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Figure 5:
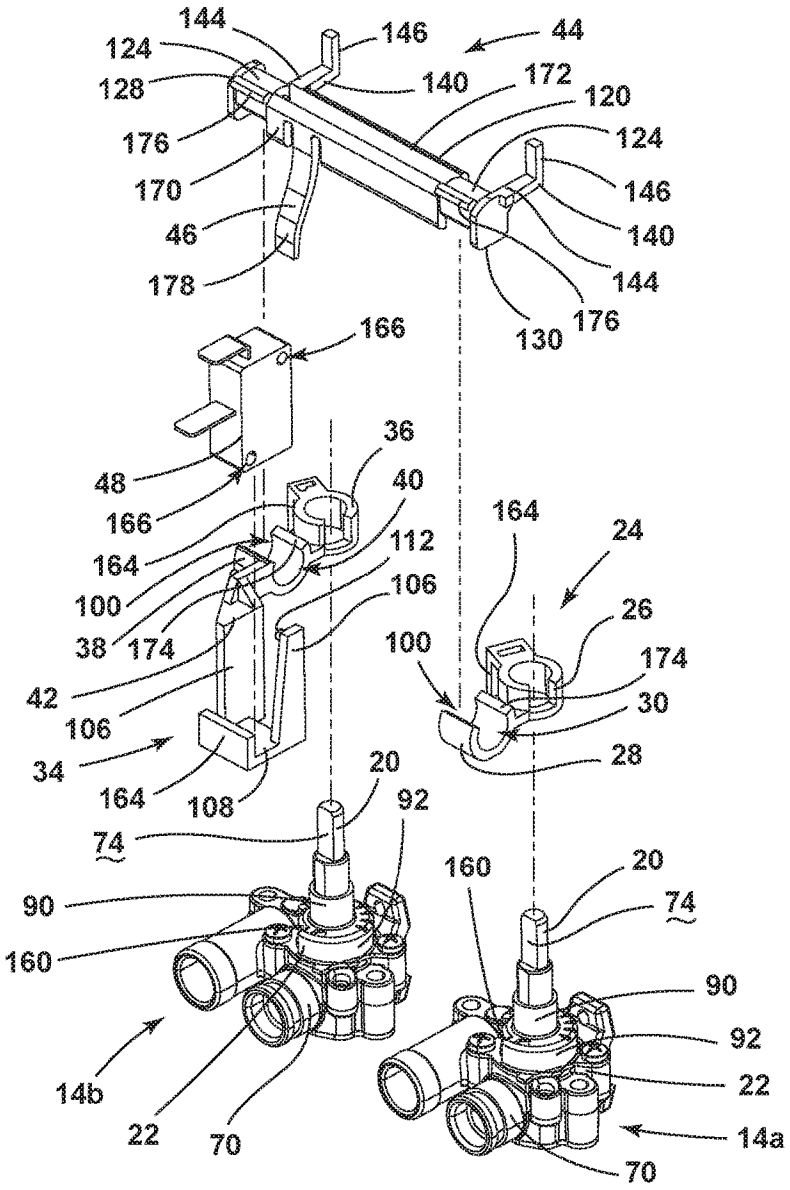
FIG. 5 is an exploded view of the ignitor assembly of FIG. 4.
Figure 6:
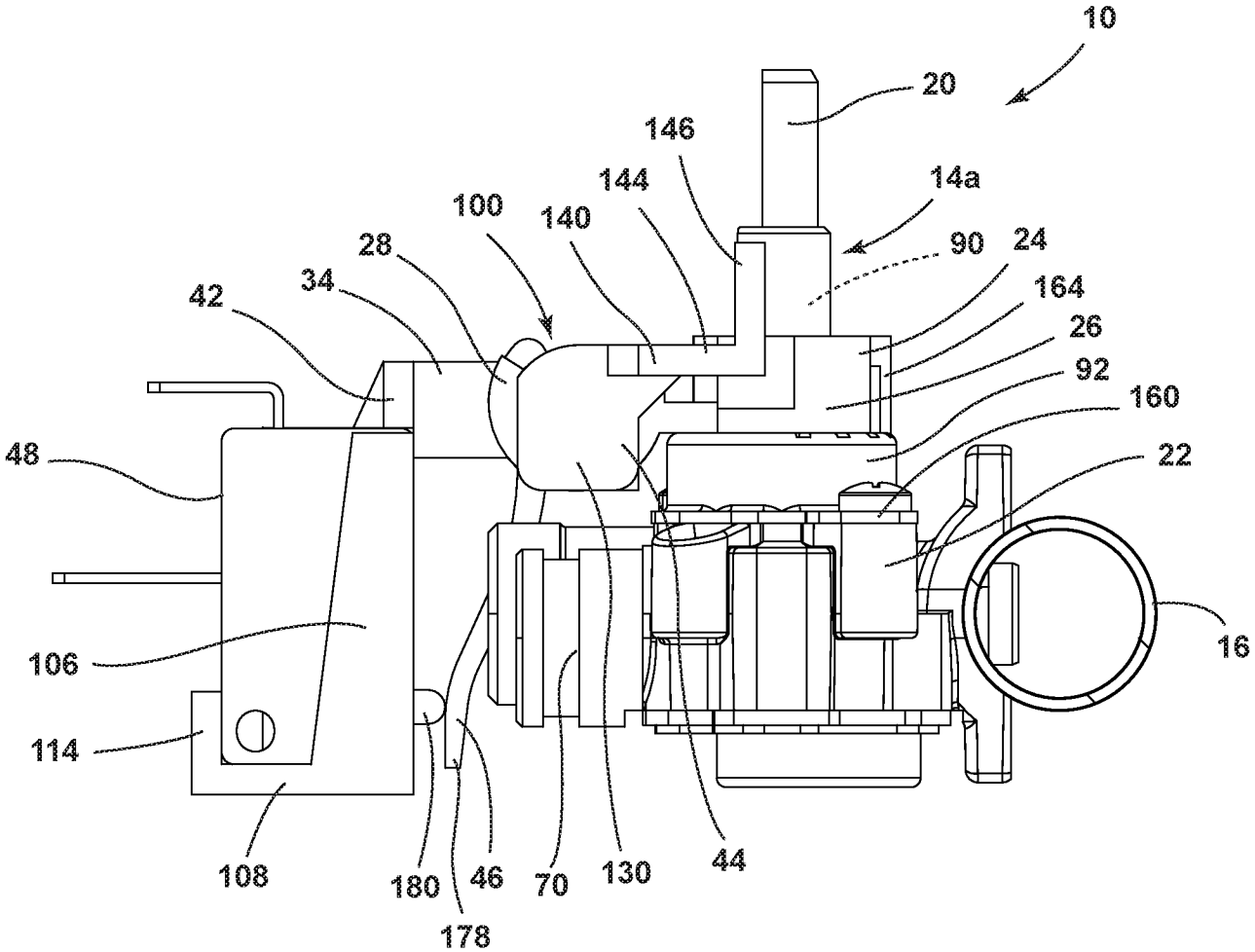
FIG. 6 is a cross-sectional view of the ignitor assembly of FIG. 4 taken along line VI-VI.
Figure 7:
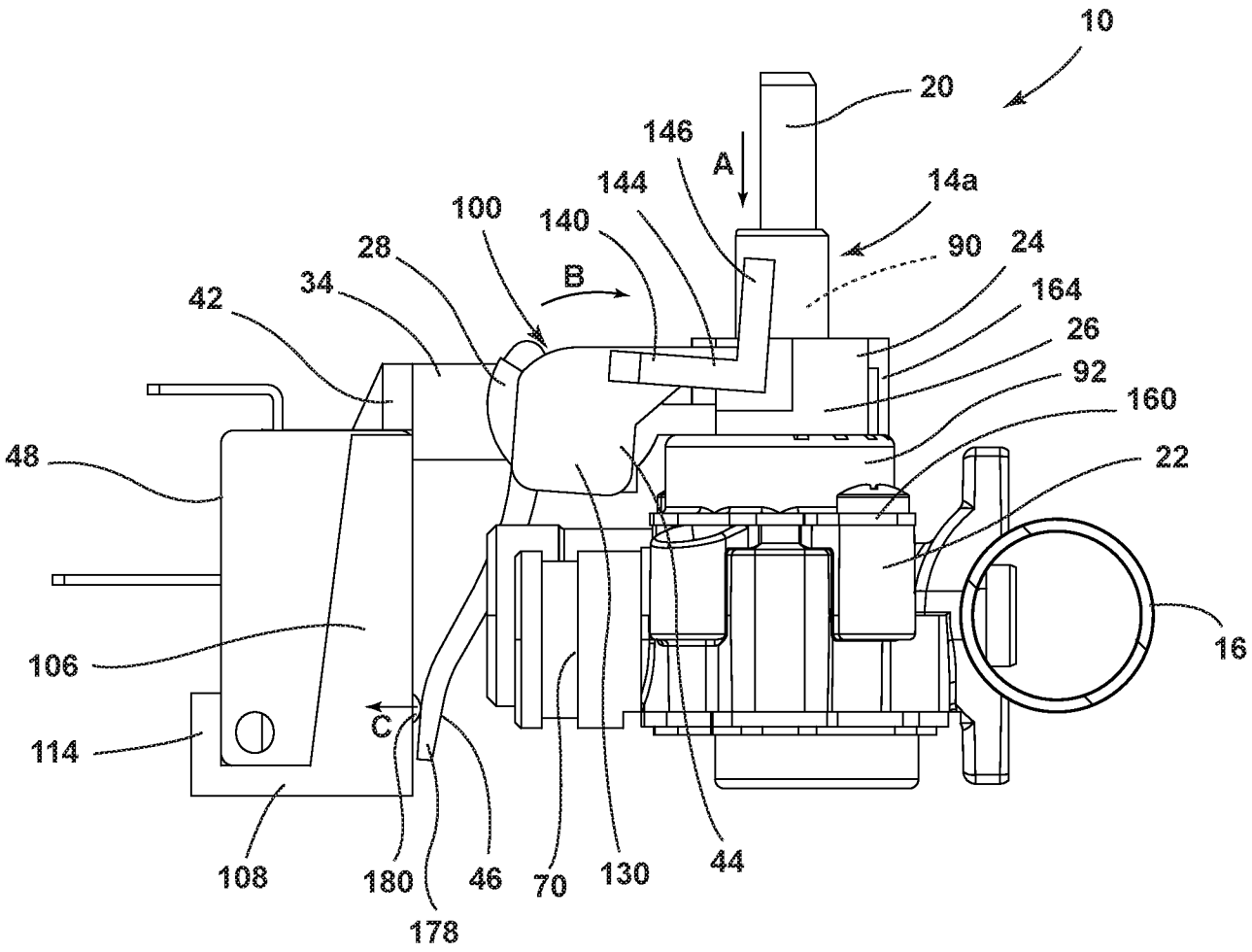
FIG. 7 is a cross-sectional view of the ignitor assembly of FIG. 4 with a cross-member in an engaged position.

Referring to FIGS. 1-7, reference numeral 10 generally designates an ignitor assembly for an appliance 12. A first tap 14*a* and a second tap 14*b* are coupled with a conduit 16. The conduit 16 may extend along a portion of a cooktop 18 of the appliance 12. Each of the first and second taps 14*a*, 14*b* includes a shaft 20 extending upward from a tab body 22. A first support 24 is coupled with the first tap 14*a*. The first support 24 includes a body portion 26 positioned about the shaft 20 of the first tap 14*a* and a protrusion 28 extending from the body portion 26 and defining a channel 30. A second support 34 is coupled with the second tap 14*b*. The second support 34 includes a body portion 36 positioned about the shaft 20 of the second tap 14*b*, a protrusion 38 extending from the body portion 36 and defining a channel 40, and a switch portion 42. A cross-member 44 is rotatably coupled with each of the first and second supports 24, 34 and includes a switch lever 46 positioned proximate the second support 34. Actuation of any one of the first and second taps 14*a*, 14*b* rotates the cross-member 44 from a disengaged position (FIG. 6) to an engaged position (FIG. 7). A switch 48 is coupled with the switch portion 42 and is configured to be actuated by the switch lever 46 of the cross-member 44 when the cross-member 44 is in the engaged position.

Referring now to FIG. 1, the appliance 12 is exemplarily illustrated including the cooktop 18 and the ignitor assembly 10. The cooktop 18 includes a plurality of gas burners 60 that are each configured to be selectively actuated by the ignitor assembly 10. The appliance 12 is illustrated as an oven having a single cooking cavity. However, it is contemplated that the cooktop 18 and the ignitor assembly 10 may be combined with any practicable cooking appliance, such as a gas oven, or may be used in any other similar appliance or combination thereof in a residential or commercial setting. Additionally, or alternatively, the cooktop 18 may be a freestanding cooktop disposed on a countertop or other similar structure. Further, the orientation of the ignitor assembly 10 may be adjusted based on the appliance 12 configuration without departing from the scope of the present disclosure. For example, the ignitor assembly 10 may be positioned proximate a top wall or front wall of the appliance 12.

Figure 2:
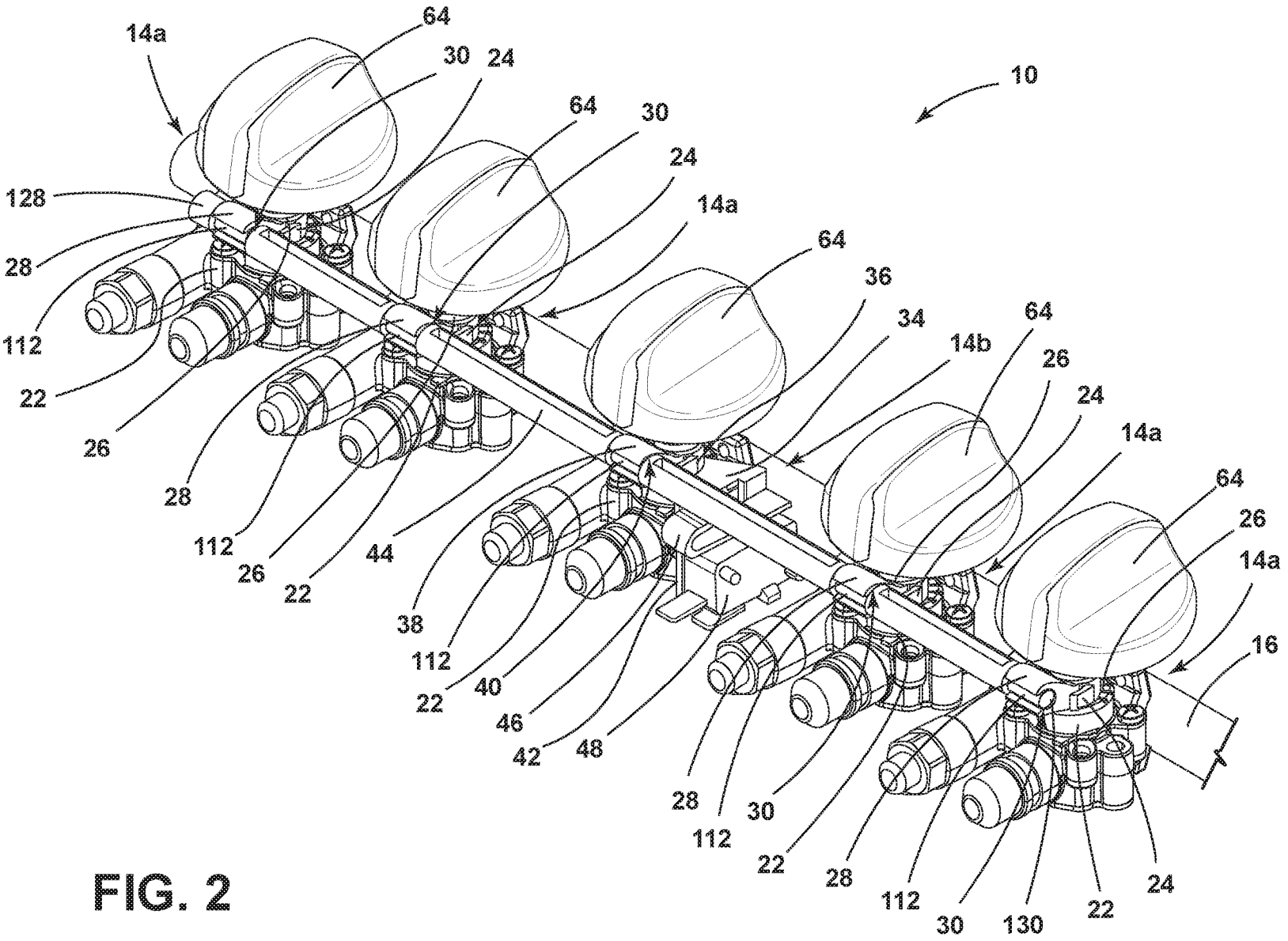
FIG. 2 is a side perspective view of an ignitor assembly, according to various examples.

Referring now to FIGS. 1 and 2, the ignitor assembly 10 is illustrated having a plurality of taps 14*a*-14*e*, including the first tap 14*a* and the second tap 14*b*. The ignitor assembly 10 is positioned proximate the cooktop 18 and includes a plurality of knobs 64 extending forward of the appliance 12. Each of the plurality of knobs 64 is coupled with one of the taps 14*a*-14*e* coupled with, and spaced along the length of, the conduit 16. The conduit 16 is configured to transport a flammable medium (e.g., fuel) to each of the taps 14*a*-14*e*.

Each of the taps 14*a*-14*e* is configured to selectively actuate one of the plurality of burners 60 of the cooktop 18 when the respective knob 64 is rotated. Each tap 14*a*-14*e* includes an outlet 70 and may be any form of tap configured to direct the medium from the conduit 16 to one of the plurality of burners 60. Each knob 64 is rotatable between a closed position and a fully open position and may be positioned at any intermediate position therebetween. In any of the closed, fully open, and intermediate positions, the knob 64 is configured to rotate the shaft 20 of the respective tap 14*a*-14*e* to provide fuel to the respective burner 60. Each knob 64 is further selectively movable into an ignition position configured to actuate the switch 48 to provide power for igniting the respective burner 60, as discussed in more detail elsewhere herein. In various examples, indicia (not shown) may be positioned on or proximate each knob 64 and may be configured to indicate the various positions of the knob 64 for user reference.

Figure 3:
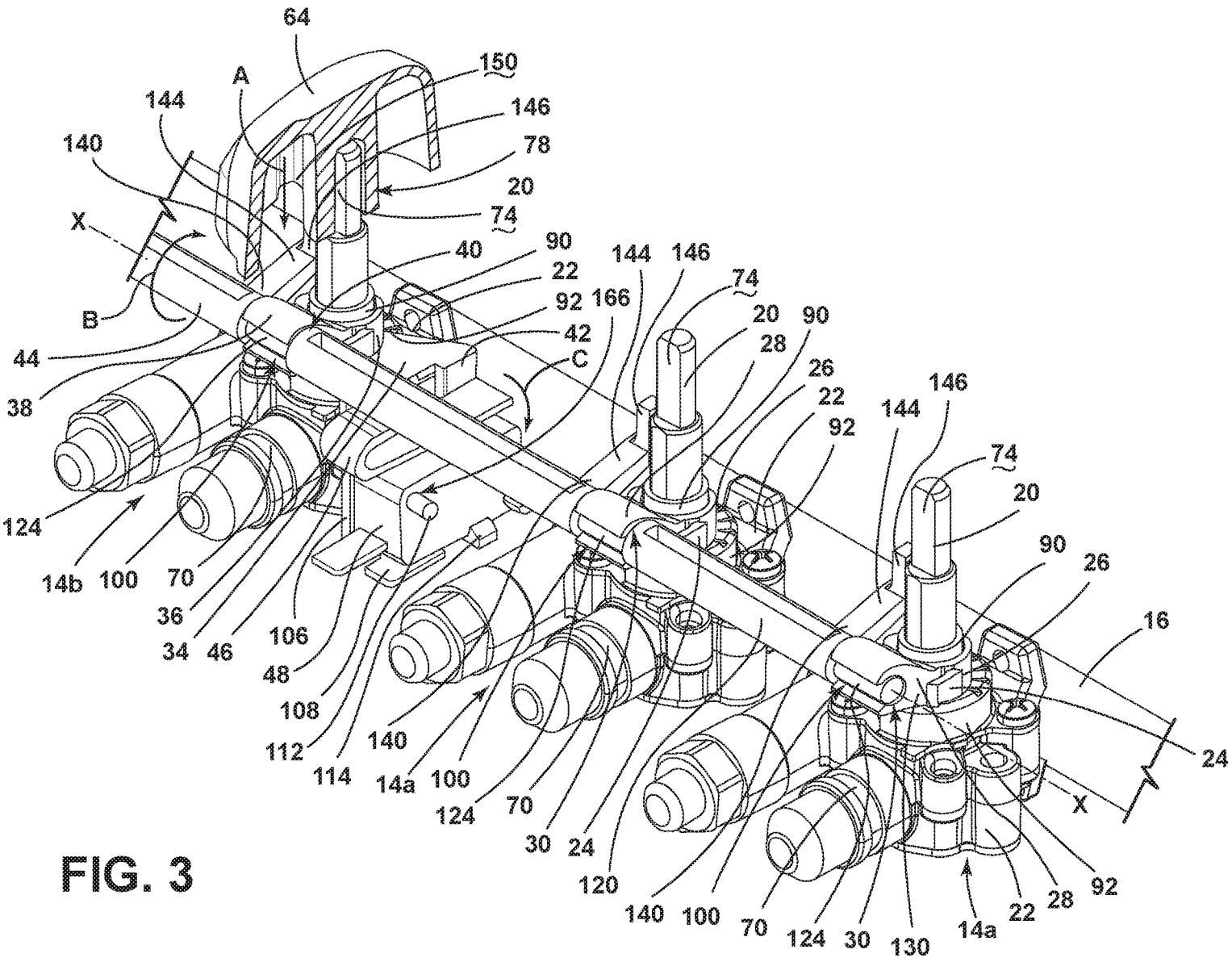
FIG. 3 is a side perspective view of the ignitor assembly of FIG. 2 with knobs removed.

Referring now to FIGS. 2 and 3, the ignitor assembly 10 is illustrated separated from the cooktop 18 and including a cross-member 44, according to a first example. The ignitor assembly 10 includes first, second, third, fourth, and fifth taps 14*a*-14*e*. As previously introduced, each of the taps 14*a*-14*e* includes a shaft 20 extending away from a tap body 22. The shaft 20 may include at least one flat surface 74 and is configured to be received by receiving well 78 of one of the plurality of knobs 64. The flat surface 74 of the shaft 20 allows rotation of the knob 64 to rotate the shaft 20 and selectively open the respective tap 14*a*-14*e*. The rotation of the shaft 20 corresponds to the rotation and position of the respective knob 64 (i.e., each shaft 20 is rotatable between a closed position, a fully open position, and any intermediate position therebetween).

As best shown in FIG. 3, each tap body 22 includes an upper circumferential step 90 and a lower circumferential step 92. The shaft 20 may be rotatable relative to one or both of the upper and lower circumferential steps 90, 92. It will be understood that the tap body 22 may include only a single circumferential step or may include more than two circumferential steps without departing from the scope of the present disclosure.

With reference to FIGS. 2 and 3, each of the taps 14*a*-14*e* is coupled with one of a plurality of first supports 24 (hereinafter referred to as member supports 24) or a second support 34 (hereinafter referred to as the switch support 34). It will be understood that any number of taps and member supports may be used while only a single switch support is included in the ignitor assembly 10. For example, as illustrated, the first tap 14*a*, the third tap 14*c*, the fourth tap 14*d*, and the fifth tap 14*e* are each coupled with a respective member support 24, and the second tap 14*b* is coupled with the single second support 34. As previously introduced, each of the supports 24, 34 includes a body portion 26, 36. The body portions 26, 36 is configured to be positioned about one of the upper and lower circumferential steps 90, 92 of the respective tap 14*a*, 14*b*. For example, each of the body portions 26, 36 may be formed as a ring configured to snap engage or slide over the selected circumferential step 90, 92.

Each support 24, 34 also includes a protrusion 28, 38 extending from the body portion 26, 36. Each protrusion 28, 38 defines a channel 30, 40 having a circular cross-section and configured to at least partially receive the cross-member 44. The protrusion 38 of the switch support 34 may be shaped to complement the protrusions 28 of the member supports 24 such that the channels 30, 40 are defined with substantially the same shape and size across the supports 24, 34, and the protrusion 28, 38 of each support 24, 34 are positioned to align such that the channels 30, 40 of each support 24, 34 are aligned and define a single axis of rotation X for the cross-member 44, as discussed in more detail herein. Each of the protrusions 28, 38 further defines an access opening 100 in communication with the respective channel 30, 40. Each access opening 100 is configured to receive the cross-member 44 to rotatably position the cross-member 44 within the channels 30, 40. The protrusion 28, 38 of each support 24, 34 are positioned to align such that the channels 30, 40 of each support 24, 34 are aligned and define a single axis of rotation X for the cross-member 44, as discussed in more detail herein.

With reference again to FIGS. 2 and 3, the switch support 34 further includes the switch portion 42 configured to position the switch 48 proximate the second tap 14*b*. The switch portion 42 may include a sidewall 106, a base 108, and at least one retention feature. For example, the switch portion 42 may include a coupling protrusion 112 extending from the sidewall 106 and configured to be received by an aperture 166 defined by the switch 48. The coupling protrusion 112 is configured to at least partially couple the switch 48 with the sidewall 106 of the switch portion 42 to retain the switch 48 relative to the switch portion 42. Additionally, or alternatively, the base 108 of the switch portion 42 may further include a raised edge 114 extending along part of or the entirety of a side of the base 108. The raised edge 114 may be configured to contact the switch 48 to maintain the position of the switch 48 relative to the base 108, or the raised edge 114 may be configured as a snap-engagement feature.

Figure 8:
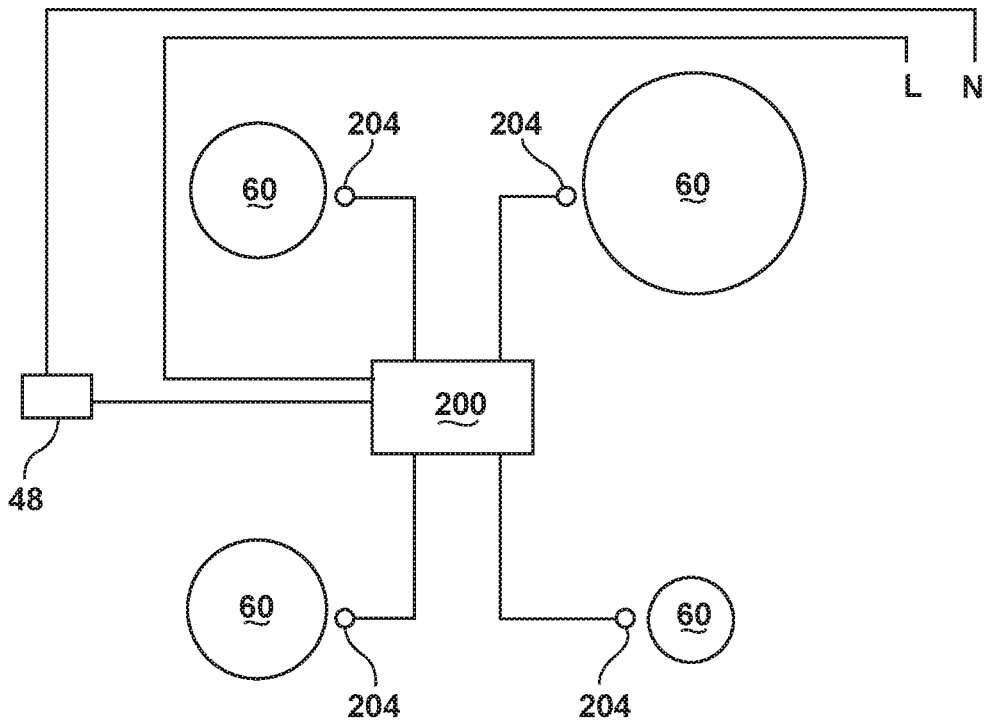
FIG. 8 is a schematic view of a switch of an ignitor assembly electrically coupled with electrical components of an appliance, according to various examples.

It will be understood that the switch 48 is configured to be selectively actuated between an open state and a closed state. In the closed state, the switch 48 is configured to provide power such that electric sparks may be generated for ignition of the gas burner 60 related to the respective tap 14*a*-14*e*. The switch 48 may be any switch configured to supply power for ignition of the ignitor assembly 10 (e.g., a spark ignition switch). For example, the switch 48 may be coupled with a power transformer 200 (FIG. 8). Individual spark generators 204 for each burner 60 may be coupled with the power transformer 200 and are powered when the switch 48 is in the closed state.

Referring still to FIGS. 2 and 3, the cross-member 44 may be received by, and rotatable within, the channels 30, 40 defined by the supports 24, 34. The cross-member 44 is rotatable about the axis X, as introduced above, between an engaged position and a disengaged position when the cross-member 44 is received by the channels 30, 40 and is coupled with the supports 24, 34.

The cross-member 44 includes a member body 120 sized to extend across the taps 14*a*-14*e*. The member body 120 may define a plurality of coupling portions 124 extending circumferentially about the member body 120 and further be configured to be received by the channels 30, 40 of the supports 24, 34. Each coupling portion 124 has a substantially circular cross-section to allow the cross-member 44 to rotate relative to the taps 14*a*-14*e*. The coupling portions 124 of the member body 120 are sized to facilitate insertion of the coupling portions 124 through the access openings 100 and into the channels 30, 40 of the supports 24, 34. Because the coupling portions 124 each have a circular cross-section, it is will be understood that the remainder of the member body 120 may have any cross-sectional shape without departing from the scope of the present disclosure. It will be understood that the member body 120 may include any number of coupling portions 124 greater than the number of taps 14*a*-14*e*.

As illustrated in FIGS. 2 and 3, at a first end 128 of the member body 120, the cross-member 44 may be configured with the coupling portions 124 spaced away from the first end 128 of the member body 120. As illustrated at a second end 130, the cross-member 44 may be configured with the coupling portions 124 spaced such that one is directly proximate the second end 130 of the member body 120. It is contemplated that any combination of end configurations of the member body 120 may be used.

The cross-member 44 further includes a plurality of tap levers 140 interspaced along the member body 120. Each tap lever 140 extends from the cross-member 44 toward the shaft 20 of the respective tap 14*a*-14*e* and is at least partially positioned proximate the shaft 20. The tap lever 140 includes a first portion 144 integrally formed with the member body 120 of the cross-member 44 and extending from the cross-member 44 at a diagonal and a second portion 146 integrally formed with the first portion 144. The second portion 146 extends from an end of the first portion 144 and is positioned beneath the respective knob 64. The second portion 146 of each tap lever 140 extends substantially parallel to the shaft 20 of the respective tap 14*a*-14*e* when the cross-member 44 is in the disengaged position. In various examples, the cross-member 44 may be biased into the disengaged position (e.g., the cross-member 44 may be biased into the disengaged position by a spring).

The cross-member 44 further includes the switch lever 46 extending from the member body 120 and positioned proximate the switch support 34. As shown in FIGS. 2 and 3, the switch lever 46 may extend tangentially from the cross-member 44 and may be positioned substantially parallel with the base 108 of the switch portion 42. The switch lever 46 is configured to contact when the cross-member 44 is rotated to the engaged position. The switch lever 46 is illustrated in FIGS. 2 and 3 as having an elongated U-shape; however, it will be understood that the switch lever 46 may be any shape configured to actuate the switch 48 from the open state to the closed state when the cross-member 44 is rotated and the switch lever 46 contacts the switch 48.

With reference to FIG. 3, only the second tap 14*b* is illustrated including the respective knob 64. However, it will be understood that the knob 64 of any of the taps 14*a*-14*e* is operated in a similar or the same manner. When one of the knobs 64 of the taps 14*a*-14*e* is depressed and rotated to the ignition position, an inner surface 150 of the knob 64 contacts the second portion 146 of the respective tap lever 140. The inner surface 150 presses the second portion 146 of the respective tap lever 140 downward along a path as indicated by arrow A. This movement of the tap lever 140 rotates the cross-member 44 about the axis of rotation X toward the taps 14*a*-14*e*, as shown by arrow B. Because of the orientation of the tap levers 140 proximate each tap 14*a*-14*e*, the rotation of the cross-member 44 may be achieved by the depression of any one of the knobs 64 and is consistent across the knobs 64 and taps 14*a*, 14*b*. Rotation of the cross-member 44 results in movement of the switch portion 42, as illustrated by arrow C. The switch lever 46 contacts the switch 48 and moves the switch 48 into a closed state. When the knob 64 is rotated out of the ignition position, the cross-member 44 is biased into the disengaged position and the switch 48 returns to the open state.

Referring now to FIGS. 4-7, the ignitor assembly 10 is illustrated separated from the cooktop 18 and including a cross-member 44 according to a second example. It will be understood that the ignitor assembly 10 illustrated in FIGS. 4-7 is a variation of the ignitor assembly 10 illustrated in FIGS. 2 and 3. Where the overall configuration of the components of the ignitor assembly 10 is similar to the ignitor assembly 10 of FIGS. 2 and 3, the same or similar reference numbers have been used. It will also be understood that either example of the ignitor assembly 10 may have any number of taps but is illustrated with only the first and second taps 14*a*, 14*b*.

Figure 4:
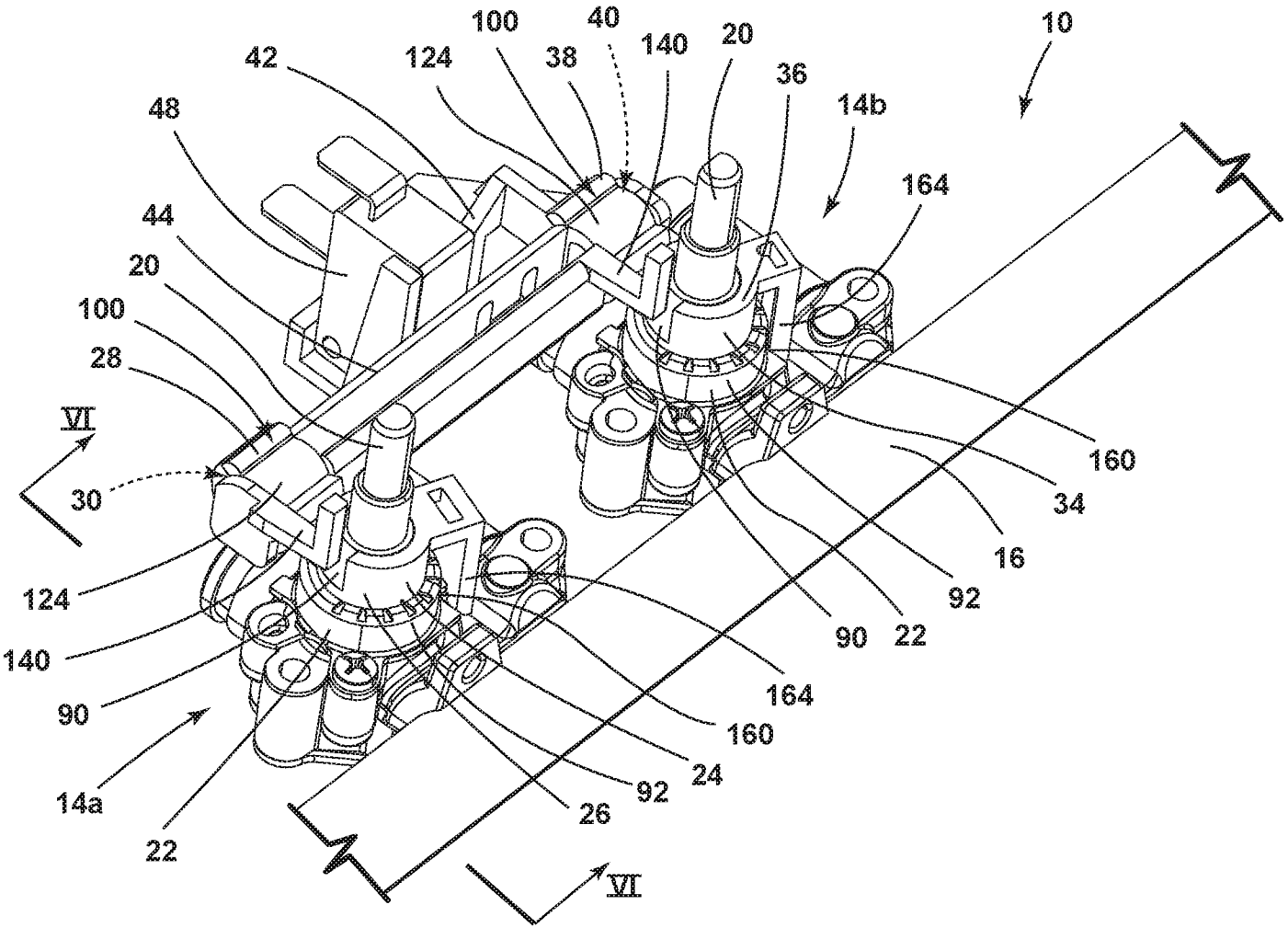
FIG. 4 is a side perspective view of an ignitor assembly, according to various examples.

As shown in FIG. 4, the ignitor assembly 10 includes the first and second taps 14*a*, 14*b* coupled with the conduit 16. Each of the taps 14*a*, 14*b* includes a shaft 20 extending away from a tap body 22. Each tap body 22 includes the upper circumferential step 90 and the lower circumferential step 92. The shaft 20 is rotatable relative to one or both of the circumferential steps 90, 92. It will be understood that the tap body 22 may be formed with only a single circumferential step or with more than two circumferential steps without departing from the scope of the present disclosure.

Each shaft 20 includes at least one flat surface 74. As previously described with respect to FIGS. 2 and 3, the flat surface 74 of the shaft 20 allows rotation of a knob (not shown) to rotate the shaft 20 and selectively open a tap 14*a*, 14*b*. Each shaft 20 is rotatable between a closed position, a fully open position, and any intermediate position therebetween and may also be rotated to an ignition position, as previously discussed.

With continued reference to FIGS. 4 and 5, each of the taps 14*a*, 14*b* is coupled with one of the supports 24, 34. As previously introduced, the first tap 14*a* is coupled with the member support 24, and the second tap 14*b* is coupled with the switch support 34. However, it will be understood that any number of taps may be coupled with respective member supports without departing from the scope of the present disclosure, but only one tap is coupled with a switch support. Each of the supports 24, 34 includes a body portion 26, 36 configured to be positioned about one of the upper and lower circumferential steps 90, 92 of the respective tap 14*a*, 14*b*. As illustrated, the body portion 26, 36 of each support 24, 34 is a ring configured to slide over the shaft 20 and at least one of the circumferential steps 90, 92. However, it is contemplated that the body portion 26, 36 of each support 24, 34 may have another method of coupling with the respective tap 14*a*, 14*b* (e.g., snap engagement features).

Each support 24, 34 includes a protrusion 28, 38 extending from the body portion 26, 36 and defining a channel 30, 40 and an access opening 100 in communication with the respective channel 30, 40. As previously discussed, each channel 30, 40 has a circular cross-section configured to at least partially receive the cross-member 44, and the supports 24, 34 are configured to align the channels 30, 40 to define a single axis of rotation X for the cross-member 44.

As illustrated in FIGS. 4-7, the tap body 22 of each tap 14*a*, 14*b* may include a rim 160 extending outward from one of the circumferential steps 90, 92. The rim 160 may extend circumferentially around part of, or an entirety of, the respective upper and lower circumferential step 90, 92. Each support 24, 34 may further include a clip 164 extending from the respective body portion 26, 36 toward the rim 160 of the tap body 22. The clip 164 is configured to fit over and/or engage with the rim 160 to couple the support 24, 34 with the respective tap 14*a*, 14*b*. The engagement of the clip 164 with the rim 160 may further ensure proper positioning of the support 24, 34 relative to the tap 14*a*, 14*b*.

With reference now to FIGS. 5 and 6, the switch support 34 further includes the switch portion 42 configured to support the switch 48. As illustrated, the switch portion 42 is spaced-apart from the respective tap 14*b* and may include one or more sidewalls 106 extending from one or more sides of a base 108. The switch portion 42 may further include at least one retention feature. For example, one or more of the sidewalls 106 of the switch portion 42 may include a coupling protrusion 112. The protrusion 112 extends from one of the sidewalls 106 and is configured to be received by an aperture 166 defined by the switch 48 to at least partially couple the switch 48 with the switch portion 42. Additionally, or alternatively, the base 108 may include a raised edge 114 extending about part of or the entirety of one or more sides of the base 108. The raised edge 114 may be configured to contact the switch 48 to maintain the position of the switch 48 relative to the base 108, or the raised edge 114 may be configured as a snap-engagement feature to couple the switch 48 with the switch portion 42. As previously introduced, the switch 48 may be any switch configured to supply power for ignition of the ignitor assembly 10 (e.g., a spark ignition switch) for ignition of one or more of the burners (FIG. 1) and is configured to be selectively actuated between an open state and a closed state.

Referring still to FIGS. 5 and 6, the cross-member 44 includes a member body 120 sized to extend across all of the taps 14*a*, 14*b*. As illustrated, the cross-member 44 includes first and second side surfaces 170, 172. Each of the side surfaces 170, 172 is substantially planar, and the side surfaces 170, 172 are oriented substantially parallel to one another. However, it is contemplated that the member body 120 may have any number of surfaces and/or may have any cross-sectional shape without departing from the scope of the present disclosure.

The cross-member 44 further includes a plurality of coupling portions 124 configured to be received by the access openings 100 of the supports 24, 34. The coupling portions 124 of the member body 120 are sized to facilitate insertion of the coupling portions 124 through the access openings 100 and into the channels 30, 40 of the supports 24, 34. As illustrated in FIGS. 4-7, each of the first and second ends 128, 130 of the member body 120 at least partially encloses one of the coupling portions 124. However, it will be understood that any combination of end configurations of the member body 120 may be used. It will be further understood that the member body 120 may include any number of coupling portions 124 greater than the number of taps 14*a*, 14*b*.

With continued reference to FIGS. 5 and 6, each coupling portion 124 has a substantially circular cross-section to allow the cross-member 44 to rotate between an engaged and a disengaged position within the channels 30, 40. A stop 176 may extend from each coupling portion 124 and may be positioned within the access opening 100. Each stop 176 may be configured to selectively contact an edge 174 of the protrusion 38 when the cross-member 44 is in the engaged position. The contact between the stop 176 and edge 174 may be configured to prevent over-rotation of the cross-member 44 when moving from the disengaged position to the engaged position.

The cross-member 44 further includes a plurality of tap levers 140 spaced-apart along the conduit 16 to position each tap lever 140 positioned proximate the shaft 20 of one of the taps 14*a*, 14*b*. Each tap lever 140 includes a first portion 144 integrally formed with the member body 120 of the cross-member 44 and a second portion 146 integrally formed with the first portion 144. The second portion 146 extends from an end of the first portion 144 and is substantially parallel to the shaft 20 of the respective tap 14*a*, 14*b* when the cross-member 44 is in the disengaged position. In various examples, the cross-member 44 is biased into the disengaged position (e.g., the cross-member 44 may be spring biased into the disengaged position).

The cross-member 44 further includes the switch lever 46 extending from the member body 120 and positioned proximate the switch support 34. As shown in FIGS. 6 and 7, the switch lever 46 extends from one of the first and second side surfaces 170, 172 of the member body 120. The switch lever 46 may include a contact portion 178 extending at least partially from the switch lever 46. The contact portion 178 may be configured to contact a protrusion 180 of the switch 48 when the cross-member 44 is rotated to the engaged position. The protrusion 180 may be configured such that the switch 48 moves to the closed state when the protrusion 180 is depressed by the switch lever 46. However, it is contemplated that the switch 48 may be otherwise actuated without the protrusion 180. It will further be understood that the switch lever 46 may be any shape configured to actuate the switch 48 from the open state to the closed state when the cross-member 44 is rotated and the switch lever 46 contacts the switch 48.

Referring still to FIGS. 6 and 7, when the knob 64 (see FIG. 1), and subsequently the shaft 20, of any one of the taps 14*a*, 14*b* is rotated to the ignition position, the second portion 146 of the respective tap lever 140 is moved downward along a path as illustrated by arrow A. This movement of the tap lever 140 is generally caused by contact of the respective knob 64 with the lever 140 during rotation of the respective knob 64, as previously discussed with respect to FIGS. 2 and 3. Movement of the second portion 146 along arrow A rotates the cross-member 44 toward the taps 14*a*, 14*b* about the axis of rotation X, as illustrated by arrow B. Because of the orientation of the tap levers 140 proximate each tap 14*a*, 14*b*, the rotation of the cross-member 44 may be achieved by the depression of any one of the knobs 64 and is consistent across the knobs 64 and taps 14*a*, 14*b* (see FIG. 1). Rotation of the cross-member 44 results in movement of the switch lever 46 in the direction illustrated by arrow C. This movement causes the contact portion 178 of the switch lever 46 to contact and depress the protrusion 180 to move the switch 48 into a closed state. When the shaft 20, and the respective knob 64 (FIG. 1), is rotated out of the ignition position, the cross-member 44 is biased into the disengaged position and the switch 48 returns to the open state.

The use of the cross-member 44 and the switch lever 46 and the tap lever 140 allows all of the taps 14*a*, 14*b* of the ignitor assembly 10 to be coupled with a single switch 48. The use of a single switch 48 reduces the number of electrical switches and components necessary for the ignitor assembly 10, which may allow for easier repair and may reduce the number of locations and/or connections within the electrical components of the ignitor assembly 10. Use of a single switch 48 also may allow for easier protection of the switch 48 from water and possible elimination of various water prevention features (e.g., O-rings for preventing water from passing through the knob seat).

According to one aspect, an ignitor assembly for an appliance includes first and second taps coupled with a conduit. Each tap may have a shaft extending upward from a body. A first support may be coupled with the first tap. The first support may include a body portion positioned about the shaft of the first tap and a protrusion extending from the body portion and defining a channel. A second support may be coupled with the second tap. The second support may include a body portion positioned about the shaft of the second tap, a protrusion extending from the body portion and defining a channel, and a switch portion. A cross-member may be rotatably coupled with each of the first and second supports and may include a switch lever positioned proximate the second support. Actuation of either of the first and second taps may rotate the cross-member. A switch may be coupled with the switch portion of the second support and may be configured to be actuated by the switch lever of the cross-member during rotation of the cross-member.

According to another aspect, first and second supports may each include a clip configured to engage with a rim of a shaft of a respective tap.

According to another aspect, an ignitor assembly may include a first knob positioned on a shaft of a first tap and configured to rotate the shaft when depressed to selectively open the first tap. The ignitor assembly may include a second knob positioned on a shaft of a second tap and configured to rotate the shaft when depressed to selectively open the second tap.

According to another aspect, a cross-member includes first and second tap levers interspaced along the cross-member. The first tap lever may be positioned proximate a shaft of a first tap, and the second tap lever may be positioned proximate a shaft of a second tap.

According to another aspect, an inner surface of a first knob may contact a first tap lever when the first knob is depressed and rotated to an ignition position, and an inner surface of a second knob may contact a second tap lever when the second knob is depressed and rotated to an ignition position.

According to another aspect, a cross-member may include a plurality of coupling portions configured to be received by channels of first and second supports.

According to another aspect, a switch lever may extend perpendicularly from a cross-member.

According to another aspect, a switch portion of a second support may be positioned between first and second taps.

According to another aspect, an ignitor assembly may include a third tap coupled with the conduit and having a shaft extending upward from a body. A third support may be coupled with the third tap and may include a body portion positioned about the shaft of the first tap and a protrusion extending from the body portion and defining a channel. A cross-member may be rotatably received by the channel of the third support and actuation of the third tap may rotate the cross-member.

According to another aspect, a second support may include a retention feature configured to at least partially couple a switch with a switch portion.

According to another aspect, a retention feature may include a raised edge extending upward from a base of a switch portion.

According to another aspect, a retention feature may include a protrusion configured to be received by an aperture defined by a switch.

According to another aspect, an ignitor assembly for a cooking appliance includes a first tap coupled with a conduit and having a shaft extending upward from a body and a second tap coupled with the conduit and having a shaft extending upward from a body. A first support may be coupled with the first tap and may include a body portion positioned about the shaft. A second support may be coupled with the second tap and may include a body portion positioned about the shaft and a switch portion extending from the body portion. A cross-member may be rotatably coupled with the first and second supports. The cross-member may include a first tap lever positioned proximate the shaft of the first tap, a second tap lever positioned proximate the shaft of the second tap, and a switch lever positioned proximate the switch portion. The cross-member may be rotatable between a disengaged position and an engaged position. A switch may be coupled with the switch portion and may be configured to be actuated by the switch lever when the cross-member is in the engaged position.

According to another aspect, an ignitor assembly may include a knob coupled with a shaft of one of first and second taps. The knob may have an inner surface configured to contact and depress one of first and second tap levers in an ignition position.

According to another aspect, each of first and second tap levers may include a first portion extending from a cross-member toward a respective tap and a second portion extending parallel to a shaft of the respective tap.

According to another aspect, a cross-member may include first and second parallel side surfaces. A switch lever may extend from one of the first and second side surfaces of the cross-member.

According to another aspect, a switch lever may extend tangentially from the cross-member.

According to another aspect, an ignitor assembly for a cooking appliance includes first and second taps coupled with a conduit extending along a portion of a cooktop. The cooktop may include first and second burners. The first burner may be selectively actuated by the first tap, and the second burner may be selectively actuated by the second tap. A first support may be coupled with the first tap, and a second support may be coupled with the second tap and may include a switch portion. A cross-member may be rotatably coupled with the first and second supports. The cross-member may include a first tap lever positioned proximate the first tap, a second tap lever positioned proximate the second tap, and a switch lever positioned proximate the switch portion. Opening of the first tap may rotate the cross-member from a disengaged position to an engaged position, and opening of the second tap may rotate the cross-member from the disengaged position to the engaged position. A switch may be coupled with the switch portion and may be configured to be actuated by the switch lever when the cross-member is in the engaged position.

According to another aspect, a first support may include a first protrusion defining a first channel. A second support may include a second protrusion defining a second channel. The first and second channels may be aligned and may be configured to receive a cross-member.

According to another aspect, a cross-member may include a plurality of coupling portions configured to be received by channels of first and second supports.

According to another aspect, a switch portion may include a retention feature configured to at least partially couple a switch with a second support.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An ignitor assembly for an appliance, comprising:

a first tap and a second tap coupled with a conduit, each of the first and second taps having a shaft extending upward from a body;

a first support coupled with the first tap and including a body portion positioned about the shaft of the first tap and a protrusion extending from the body portion and defining a channel;

a second support coupled with the second tap and including a body portion positioned about the shaft of the second tap, a protrusion extending from the body portion and defining a channel, and a switch portion;

a cross-member rotatably coupled with each of the first and second supports and including a switch lever positioned proximate the second support, wherein actuation of either of the first and second taps rotates the cross-member; and a switch coupled with the switch portion of the second support and configured to be actuated by the switch lever of the cross-member during rotation of the cross-member.

2. The ignitor assembly of claim 1, wherein each of the first and second supports includes a clip configured to engage with a rim of the shaft of the respective tap.

3. The ignitor assembly of claim 1, further comprising:

a first knob positioned on the shaft of the first tap and configured to rotate the shaft when depressed to selectively open the first tap; and a second knob positioned on the shaft of the second tap and configured to rotate the shaft when depressed to selectively open the second tap.

4. The ignitor assembly of claim 3, wherein the cross-member includes first and second tap levers interspaced along the cross-member, the first tap lever positioned proximate the shaft of the first tap and the second tap lever positioned proximate the shaft of the second tap.

5. The ignitor assembly of claim 4, wherein an inner surface of the first knob contacts the first tap lever when the first knob is depressed and rotated to an ignition position, and an inner surface of the second knob contacts the second tap lever when the second knob is depressed and rotated to an ignition position.

6. The ignitor assembly of claim 1, wherein the cross-member includes a plurality of coupling portions configured to be received by the channels of the first and second supports.

7. The ignitor assembly of claim 1, wherein the switch lever extends perpendicularly from the cross-member.

8. The ignitor assembly of claim 1, further comprising:

a third tap coupled with the conduit and having a shaft extending upward from a body; and a third support coupled with the third tap and including a body portion positioned about the shaft of the first tap and a protrusion extending from the body portion and defining a channel, wherein the cross-member is rotatably received by the channel of the third support and actuation of the third tap rotates the cross-member.

9. The ignitor assembly of claim 1, wherein the second support includes a retention feature configured to at least partially couple the switch with the switch portion.

10. The ignitor assembly of claim 9, wherein the retention feature comprises a raised edge extending upward from a base of the switch portion.

11. The ignitor assembly of claim 9, wherein the retention feature comprises a protrusion configured to be received by an aperture defined by the switch.

12. An ignitor assembly for a cooking appliance, comprising:

a first tap coupled with a conduit and having a shaft extending upward from a body;

a second tap coupled with the conduit and having a shaft extending upward from a body;

a first support coupled with the first tap and including a body portion positioned about the shaft;

a second support coupled with the second tap and including a body portion positioned about the shaft and a switch portion extending from the body portion;

a cross-member rotatably coupled with the first and second supports, the cross-member including a first tap lever positioned proximate the shaft of the first tap, a second tap lever positioned proximate the shaft of the second tap, and a switch lever positioned proximate the switch portion, wherein the cross-member is rotatable between a disengaged position and an engaged position; and a switch coupled with the switch portion and configured to be actuated by the switch lever when the cross-member is in the engaged position.

13. The ignitor assembly of claim 12, further comprising:

a knob coupled with the shaft of one of the first and second taps, the knob having an inner surface configured to contact and depress one of the first and second tap levers in an ignition position.

14. The ignitor assembly of claim 12, wherein each of the first and second tap levers includes a first portion extending from the cross-member toward the respective tap and a second portion extending parallel to the shaft of the respective tap.

15. The ignitor assembly of claim 12, wherein the cross-member includes first and second parallel side surfaces and the switch lever extends from one of the first and second side surfaces of the cross-member.

16. The ignitor assembly of claim 12, wherein the switch lever extends tangentially from the cross-member.

17. An ignitor assembly for a cooking appliance, comprising:

first and second taps coupled with a conduit extending along a portion of a cooktop, wherein the cooktop includes first and second burners, the first burner selectively actuated by the first tap and the second burner selectively actuated by the second tap;

a first support coupled with the first tap;

a second support coupled with the second tap and including a switch portion;

a cross-member rotatably coupled with the first and second supports, the cross-member including a first tap lever positioned proximate the first tap, a second tap lever positioned proximate the second tap, and a switch lever positioned proximate the switch portion, wherein opening of the first tap rotates the cross-member from a disengaged position to an engaged position and opening of the second tap rotates the cross-member from the disengaged position to the engaged position; and a switch coupled with the switch portion and configured to be actuated by the switch lever when the cross-member is in the engaged position.

18. The ignitor assembly of claim 17, wherein the first support includes a first protrusion defining a first channel and the second support includes a second protrusion defining a second channel, the first and second channels aligned and configured to receive the cross-member.

19. The ignitor assembly of claim 18, wherein the cross-member includes a plurality of coupling portions configured to be received by the channels of the first and second supports.

20. The ignitor assembly of claim 17, wherein the switch portion includes a retention feature configured to at least partially couple the switch with the second support.

* * * * *